US008598481B2

(12) United States Patent
Wang et al.

(10) Patent No.: US 8,598,481 B2
(45) Date of Patent: Dec. 3, 2013

(54) SWITCH WITH SINUATED AIR-PASSAGEWAY

(75) Inventors: Yong-Jia Wang, Shenzhen (CN); Liang Sun, Shenzhen (CN); Shi-Jie Tan, Shenzhen (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 180 days.

(21) Appl. No.: 13/313,311

(22) Filed: Dec. 7, 2011

(65) Prior Publication Data

US 2012/0138443 A1 Jun. 7, 2012

(51) Int. Cl.
*H01H 1/10* (2006.01)

(52) U.S. Cl.
USPC ..... 200/515; 200/292

(58) Field of Classification Search
USPC ..... 200/515, 293, 303, 306, 292, 513, 516, 200/406, 302.1, 302.2
See application file for complete search history.

(56) References Cited

U.S. PATENT DOCUMENTS 4,046,975 A * 9/1977 Seeger, Jr. ..... 200/515
4,254,309 A * 3/1981 Johnson ..... 200/5 A
4,412,113 A * 10/1983 Mitsugi et al. ..... 200/406
4,596,912 A * 6/1986 Hattori ..... 200/302.2
4,794,215 A * 12/1988 Sawada et al. ..... 200/512
4,913,285 A * 4/1990 Tsutsumi et al. ..... 200/306
5,874,700 A * 2/1999 Hochgesang ..... 200/515
6,441,330 B2 * 8/2002 Liao ..... 200/515

FOREIGN PATENT DOCUMENTS

TW M363062 8/2009

* cited by examiner

*Primary Examiner* — Edwin A. Leon
*Assistant Examiner* — Harshad Patel
(74) *Attorney, Agent, or Firm* — Ming Chieh Chang; Wei Te Chung

(57) ABSTRACT

A switch includes an insulative housing, a pair of first and second contacts fixed in the insulative housing and a dome-shaped moveable contact. The insulative housing includes a receiving space and a first peripheral wall located outside of the receiving space. The first and the second contacts include first and second contacting sections, respectively. The first and the second contacting sections are separated a distance from each other and exposed in the receiving space. The dome-shaped moveable contact is mounted in the receiving space under condition that the moveable contact is constantly in contact with the second contacting section while the moveable contact is alternatively driven to engage with the first contacting section so as to establish electrical connection between the first contact and the second contact. The first peripheral wall defines a sinuated air-passageway communicating the receiving space to outside.

20 Claims, 3 Drawing Sheets

SWITCH WITH SINUATED AIR-PASSAGEWAY

BACKGROUND OF THE INVENTION

1. Field of the Invention

The present disclosure relates to a switch, and more particularly to a switch with sinuated air-passageway.

2. Description of Related Art

Taiwan Patent Issue No. M363062 issued to the same assignee of the instant application on Aug. 11, 2009, discloses a conventional switch including an insulative housing, a dome-shaped moveable contact mounted to the insulative housing, an immoveable contact group fixed in the insulative housing, and a cover shielding the insulative housing. The insulative housing defines a receiving space for mounting the dome-shaped moveable contact and a plurality of linear air-passageways communicating the receiving space to outside. However, with such linear air-passageways, the insulative housing becomes weak and apt to result in warpage especially when the dome-shaped moveable contact and the immoveable contact group are insert molded in the insulative housing. Besides, with such linear air-passageways, dust may easily enter the switch and result in poor contact.

Hence, it is desirable to provide a switch with improved air-passageway.

BRIEF SUMMARY OF THE INVENTION

The present disclosure provides a switch including an insulative housing, a pair of first and second contacts fixed in the insulative housing and a dome-shaped moveable contact. The insulative housing includes a receiving space and a first peripheral wall located outside of the receiving space. The first and the second contacts include first and second contacting sections, respectively. The first and the second contacting sections are separated a distance from each other and exposed in the receiving space. The dome-shaped moveable contact is mounted in the receiving space under condition that the moveable contact is constantly in contact with the second contacting section while the moveable contact is alternatively driven to engage with the first contacting section so as to establish electrical connection between the first contact and the second contact. The first peripheral wall defines a sinuated air-passageway communicating the receiving space to outside.

The foregoing has outlined rather broadly the features and technical advantages of the present disclosure in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION OF THE PREFERRED EMBODIMENT

Figure 1:
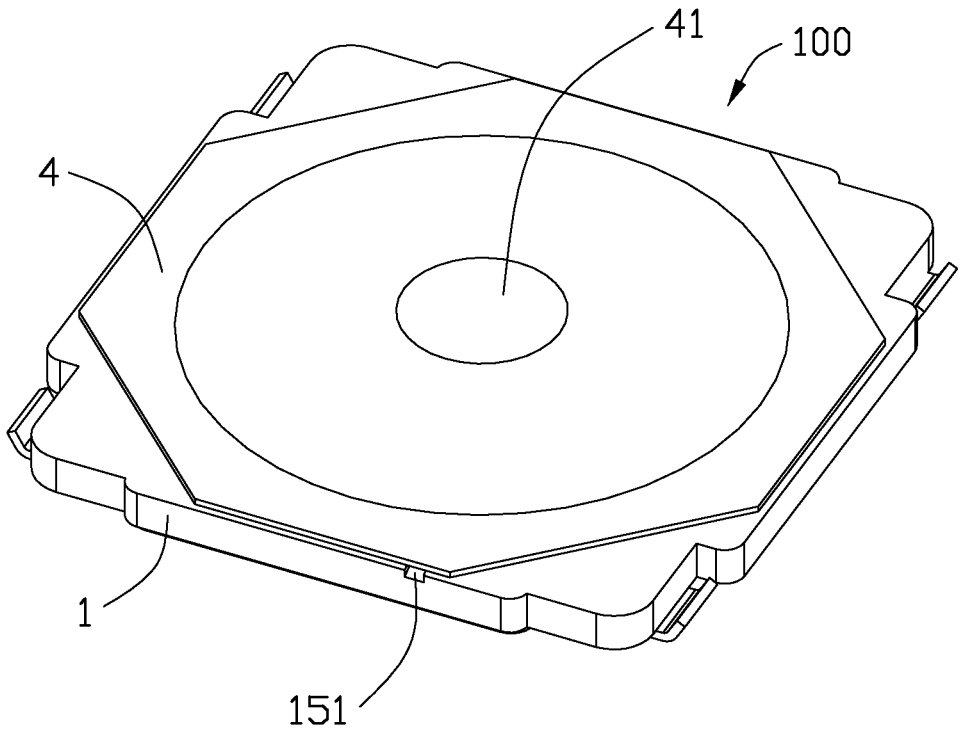
FIG. 1 is a perspective view of a switch in accordance with an illustrated embodiment of the present disclosure.
Figure 2:
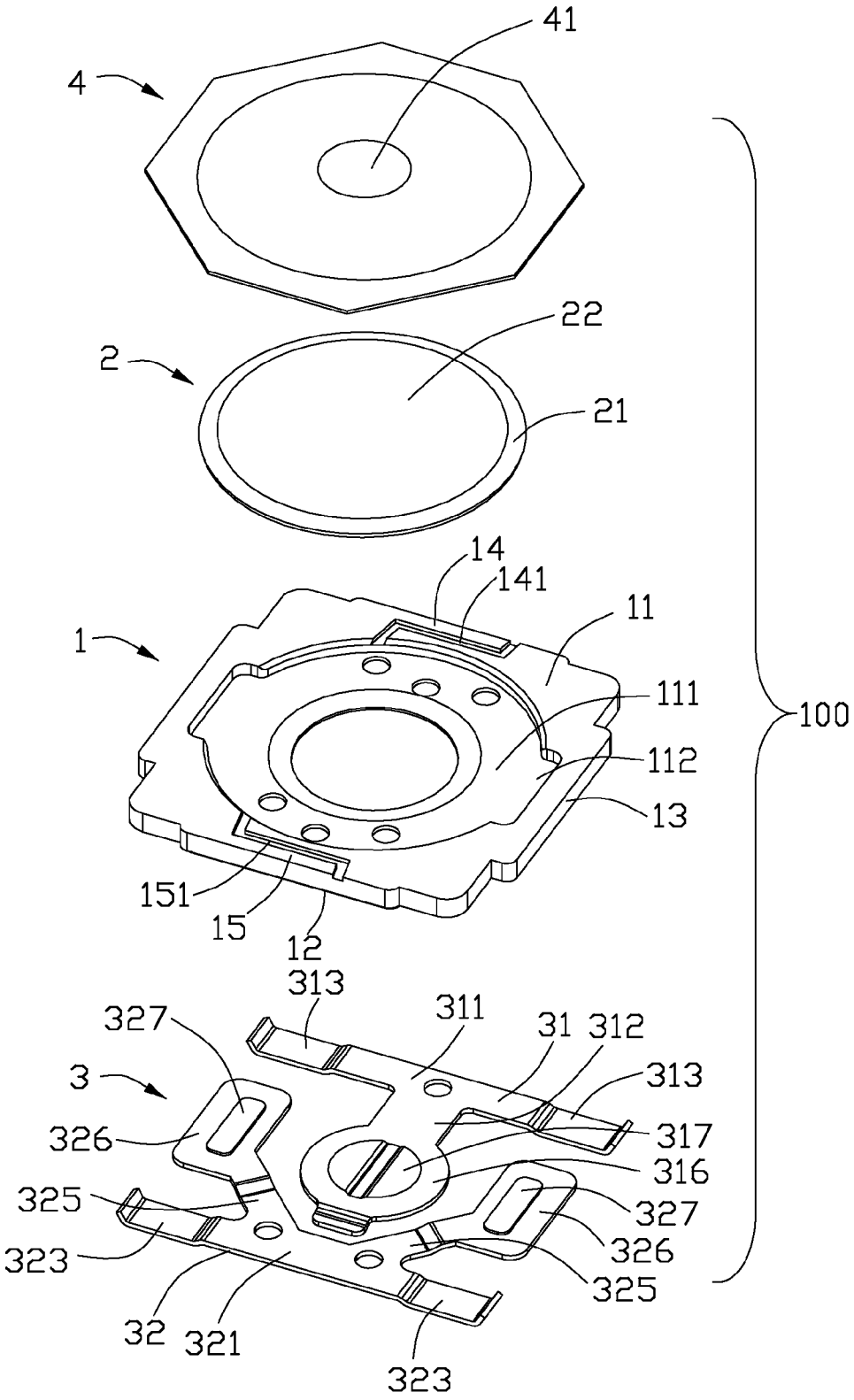
FIG. 2 is an exploded view of the switch as shown in FIG. 1.
Figure 3:
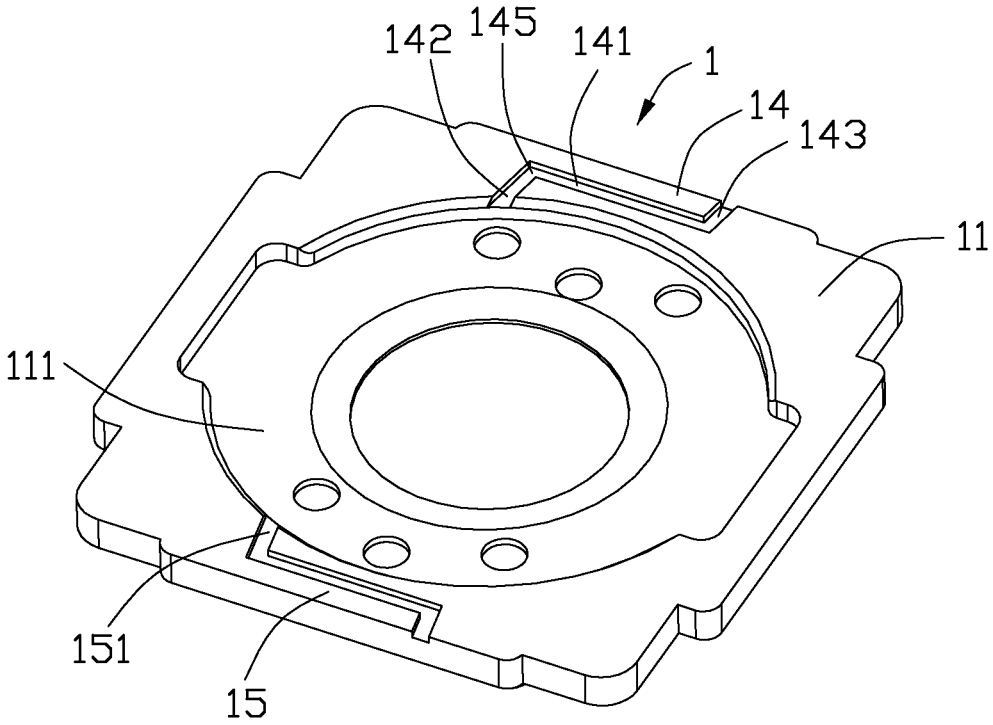
FIG. 3 is a perspective view of an insulative housing of the switch.

Reference will now be made to the drawing figures to describe the preferred embodiment of the present disclosure in detail. Referring to FIGS. 1 to 3, the illustrated embodiment of the present disclosure discloses a switch 100 including an insulative housing 1, a dome-shaped moveable contact 2 mounted to the insulative housing 1, an immoveable contact group 3 fixed in the insulative housing 1, and a cover 4 shielding the insulative housing 1.

The insulative housing 1 is square-shaped and includes a top wall 11, a bottom wall 12 and four peripheral walls 13. The top wall 11 defines a round receiving space 111 at a middle section thereof and a pair of rectangular recesses 112 in communication with and positioned at lateral sides of the receiving space 111. The four peripheral walls 13 enclose the receiving space 111 and include a first peripheral wall 14 and a second peripheral wall 15 opposite to the first peripheral wall 14. As shown in FIG. 3, the first peripheral wall 14 defines a first sinuated air-passageway 141 communicating the receiving space 111 to outside. In detail, the first sinuated air-passageway 141 is Z-shaped and includes a first slot 142 opened to the receiving space 111, a second slot 143 opened to the outside and a middle slot 144 connecting the first slot 142 and the second slot 143. The first slot 142 is substantially parallel to the second slot 143 while they are in nonalignment with each other. The middle slot 144 is perpendicular to the first slot 142 and the second slot 143 so that at least one right-angle inflection point 145 is formed. Comparing with linear air-passageways, the first sinuated air-passageway 141 not only makes the insulative housing stronger to resist deformation, but also much better to prevent external powder from entering the receiving space 111 of the switch 100 through the first sinuated air-passageway 141. The second peripheral wall 15 defines a second sinuated air-passageway 151 communicating the receiving space 111 to outside as well. The first and the second air-passageways 141, 151 are symmetrical with each other and expose the receiving space 111 to the outside along opposite directions. It is understandable that with the at least one right-angle inflection point 145, the external powder becomes much more difficult to enter the receiving space 111.

Referring to FIG. 2, the immoveable contact group 3 is insert molded with the insulative housing 1 and includes a pair of first and second contacts 31, 32 both made of metal. The first contact 31 is T-shaped and includes a longitudinal portion 311 and a transverse portion 312 extending perpendicularly from a middle section of the longitudinal portion 311. The longitudinal portion 311 includes a pair of depressed soldering sections 313 exposed on the bottom wall 12 for mounting to a PCB (not shown). The transverse portion 312 includes an enlarged round portion 316 which includes a round first contacting section 317. The second contact 32 is K-shaped and includes a longitudinal portion 321 and a pair of bifurcated second contacting arms 325 extending towards the first contact 31. The longitudinal portion 321 includes a pair of depressed soldering sections 323 exposed on the bottom wall 12 for mounting to the PCB. Each second contacting arm 325 includes an enlarged rectangular portion 326 which includes a second contacting section 327.

The first contacting section 317 is positioned between the pair of second contacting sections 327, and each of the second contacting sections 327 is separated a distance from the first contacting section 317. The dome-shaped moveable contact 2 is made of metal as well and is situated above the first and the second contacts 31, 32. The moveable contact 2 includes an outer edge 21 constantly in contact with the second contacting sections 327 and a deformable portion 22 alternatively in contact with the second contacting section so as to establish electrical connection between the first contacting section 317 and the second contacting sections 327. In detail, in an initial status, the deformable portion 22 is upwardly knobbed and disengages with the first contacting section 317 so that the first contact 31 and the second contact 32 are disconnected with each other. In a mating status when the deformable portion 22 is downwardly driven to be deformable to engage with the first contacting section 317, electrical connection between the first contact 31 and the second contact 32 are established. As a result, switch signals generate.

Referring to FIG. 2, the cover 4 is octagonal and includes a central pressing portion 41 which is pressed by external force so as to downwardly drive the deformable portion 22 of the moveable contact 2.

It is to be understood, however, that even though numerous, characteristics and advantages of the present disclosure have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. A switch comprising:

an insulative housing defining a receiving space and a first peripheral wall located outside of the receiving space;

first and second contacts fixed in the insulative housing, the first and the second contacts comprising first and second contacting sections, respectively, the first and the second contacting sections being separated a distance from each other and exposed in the receiving space; and a dome-shaped moveable contact mounted in the receiving space, the moveable contact being constantly in contact with the second contacting section and alternatively deformable to engage with the first contacting section so as to establish electrical connection between the first contact and the second contact; wherein the first peripheral wall defines a sinuated air-passageway communicating the receiving space to outside.

2. The switch as claimed in claim 1, wherein the sinuated air-passageway comprises a first slot opened to the receiving space and a second slot opened to the outside in condition that the first slot is in nonalignment with the second slot.

3. The switch as claimed in claim 2, wherein the first sot is substantially parallel to the second slot.

4. The switch as claimed in claim 3, wherein the sinuated air-passageway comprises a middle slot connecting the first slot and the second slot, the middle slot being perpendicular to the first slot and the second slot.

5. The switch as claimed in claim 1, wherein the sinuated air-passageway is Z-shaped.

6. The switch as claimed in claim 1, wherein the insulative housing comprises a second peripheral wall opposite to the first peripheral wall with the receiving spaced positioned therebetween, the second peripheral wall defining another sinuated air-passageway communicating the receiving space to the outside.

7. The switch as claimed in claim 6, wherein the sinuated air-passageway and the another sinuated air-passageway are symmetrical with each other.

8. The switch as claimed in claim 1, wherein the insulative housing comprises a top wall with receiving spaced recessed therefrom and a bottom wall opposite to the top wall, the first and the second contacts being insert molded with the insulative housing and comprising first and second soldering sections, respectively, the first and the second soldering sections being exposed on the bottom wall.

9. A switch comprising:

an insulative housing defining a receiving space and a peripheral wall located outside of the receiving space;

first and second contacts fixed in the insulative housing, the first contact comprising a first contacting section exposed in the receiving space, the second contact comprising a pair of bifurcated second contacting sections exposed in the receiving space, the first contacting section being positioned between the pair of second contacting sections and each of the second contacting sections being separated a distance from the first contacting section; and a dome-shaped moveable contact mounted in the receiving space, the moveable contact being constantly in contact with the second contacting sections and alternatively in contact with the first contacting section so as to establish electrical connection between the first contact and the second contact; wherein the peripheral wall defines an air-passageway communicating the receiving space to outside, the air-passageway comprising at least one right-angle inflection point.

10. The switch as claimed in claim 9, wherein the air-passageway comprises a first slot opened to the receiving space and a second slot opened to the outside in condition that the first slot is in nonalignment with the second slot.

11. The switch as claimed in claim 10, wherein the first sot is substantially parallel to the second slot, the air-passageway comprising a middle slot connecting the first slot and the second slot, the middle slot being perpendicular to the first slot and the second slot.

12. The switch as claimed in claim 9, wherein the air-passageway is Z-shaped.

13. The switch as claimed in claim 9, wherein the insulative housing comprises another peripheral wall opposite to the peripheral wall with the receiving spaced positioned therebetween, the another peripheral wall defining another air-passageway communicating the receiving space to the outside.

14. The switch as claimed in claim 13, wherein the air-passageway and the another air-passageway expose the receiving space to the outside along opposite directions.

15. The switch as claimed in claim 13, wherein the air-passageway and the another air-passageway are symmetrical with each other.

16. An electrical switch comprising:

an insulative housing defining a receiving space surrounded by a peripheral wall;

a set of fixed contacts disposed in the housing and defining inner contacting sections and outer mounting sections;

a moving contact disposed in the receiving space of the housing and up and down moveable between a first position where the set of fixed contacts are electrically connected and a second position where the set of fixed contacts are electrically disconnected; and an air passageway formed in the peripheral wall of the housing to transversely communicate the receiving space with an exterior; wherein the air passageway is not straight for anti-warpage thereabouts.

17. The electrical switch as claimed in claim 16, wherein the receiving space defines an upper level at which the air passageway is located, and a lower level at which a periphery of the moveable contact is located.

18. The electrical switch as claimed in claim 16, wherein the air passageway defines at least one angled section.

19. The electrical switch as claimed in claim 16, wherein the air passageway defines an essentially Z-shaped structure.

20. The electrical switch as claimed in claim 16, further including a cover downwardly shielding the moveable contact and the housing.

* * * * *